US005115919A

United States Patent [19]

Dorman

[11] Patent Number: 5,115,919

[45] Date of Patent: May 26, 1992

[54] MAGNETIC CARD FILING ASSEMBLY

[76] Inventor: Isidore Dorman, 147-71 6th Ave., Whitestone, N.Y. 11357

[21] Appl. No.: 739,309

[22] Filed: Aug. 1, 1991

[51] Int. Cl.[5] ..... A47F 5/00

[52] U.S. Cl. ..... 211/50; 211/40; 211/184; 211/DIG. 1

[58] Field of Search ..... 211/DIG. 1, 50, 40, 211/41, 43, 184

[56] References Cited

U.S. PATENT DOCUMENTS

| | | | |
|---|---|---|---|
| 2,959,293 | 11/1960 | Von Meyer | 211/40 |
| 3,974,918 | 8/1976 | Varemchuk | 211/DIG. 1 X |
| 4,494,659 | 1/1985 | Spees | 211/DIG. 1 X |
| 4,763,795 | 8/1988 | Metzger et al. | 211/50 X |
| 4,781,292 | 11/1988 | Sacherman et al. | 211/40 X |

*Primary Examiner*—Robert W. Gibson, Jr.

*Attorney, Agent, or Firm*—Michael Ebert

[57] ABSTRACT

A card filing assembly in which file cards are accommodated in a tray or other holder dimensioned to store a stack of cards, each of which at its lower edge has a stripe or band of ferromagnetic material attached thereto. The file card holder is provided with opposing side walls to confine the stack of cards to the holder and a pair of parallel rails each defined by a transversely-polarized permanent magnet strip running the length of the holder and sandwiched between opposing pole pieces. The cards stored in the holder bridge the rails, with their lower edges resting on the pole pieces, whereby the cards are held to the rails by magnetic attraction, yet the cards so held may be angled to facilitate their inspection or slid along the rails, or removed from the rails without, in doing so, in any way mutilating the cards.

9 Claims, 3 Drawing Sheets

MAGNETIC CARD FILING ASSEMBLY

BACKGROUND OF INVENTION

1. Field of Invention

This invention relates generally to file card systems in which file cards stacked in holders are removable therefrom, and more particularly to a magnetic card filing assembly in which file cards are retained by magnetic attraction in the holder and can be angled to permit their inspection, slid within the holder or removed therefrom without, in doing so, mutilating the card in any way.

2. Status of Prior Art

In a conventional card filing system, the cards which carry data of interest, are stacked in a tray, a cabinet or other holder dimensioned to accommodate a stack of cards, the arrangement being such that the cards can be angled within the holder to facilitate their inspection, or slid within the holder to make room for additional cards, or removed from the holder so that they can be consulted and then returned to the holder or replaced by another card. In order to retain cards in the holder, the common practice is to provide a card having at least one keyhole slot punched therein at its lower edge, the card cooperating with a retaining rod in the holder which goes through the keyhole slots in the card stack and thereby retains the cards in the holder.

In order to remove a card from the file or to add a fresh card thereto without first pulling out the retaining rod, one must either disengage the card from the rod, or bring the card into engagement therewith, as the case may be. In either event, because the rod has a diameter which matches the hole portion of the keyhole slot in the card but is greater than the inlet to this hole, the act of attaching a card to a retaining rod or removing a card therefrom is troublesome. It not only involves some difficulty, especially if the cards are tightly packed in the holder, as so often is the case, but it also may result in mutilation of the keyhole slot, as a consequence of which the card will not be retained in the holder. In some instances, instead of a retaining rod, use is made of "T" shaped rails which engage the keyhole slots on the cards.

In the well-known ROLODEX file, instead of a straight line holder for storing a stack of cards, the holder is constituted by a rotatable cylinder supported within a casing and having a pair of retaining rings mounted concentrically thereon, the file cards being provided at their lower edges with a corresponding pair of keyhole slots which are engaged by the rings.

The advantage of the ROLODEX arrangement is that because the cards retained by the rings are in a circular array whose inner circumference is smaller than its outer circumference, the cards fan out, thereby facilitating their inspection. However, in order to add a card to this file or remove a card therefrom, the card must be brought into engagement with the rings or disengaged therefrom, and this action may result in mutilation of the keyhole slots.

Inasmuch as the present invention uses magnetic attraction in place of retaining rods and keyhole slots in order to retain cards in a card holder, the following patents are of prior art interest.

The Remke U.S. Pat. No. 3,224,824 shows a card file arrangement in which magnetic forces serve to fan out portions of a stacked array of cards to facilitate visual inspection. The cards are held in a drawer which slides out of a cabinet. Each card has at its bottom end a thin lamination of ferromagnetic material. In the cabinet (not the drawer) is a permanent magnet below the drawer. This magnetic arrangement serves not to hold the cards in place but to fan them out when the drawer is slid out of the cabinet.

U.S. Pat. No. 3,250,274 to Mathiesen discloses an elaborate magnetic arrangement in which each card has a magnetic area and the cards are caused to fan out "due to magnetic repulsion." U.S. Pat. No. 3,822,082 to Mathiesen also uses magnetic repulsion to cause file cards to spread out. Also involving magnetic repulsion is the file card having magnetic inserts shown in Mathiesen U.S. Pat. No. 3,033,208.

The Dahl, Jr. U.S. Pat. Nos. 3,455,770 and 3,736,680 deal with magnetic cards which are caused to fan out and separate to reveal the matter printed thereon.

The term "card," as used herein, is not limited to a sheet of paperboard, although most file cards take this form. In the above-noted Dahl, Jr. U.S. Pat. No. 3,736,680, for example, the card takes the form of a multi-channel microfiche jacket having microfilm strips stored in the channels. Such jackets are used to store records and are filed in the manner of ordinary cards in a suitable tray or holder from which the jackets may be removed or added thereto. Also included in the term are file folders in which documents to be filed are inserted between the leaves of the folders.

SUMMARY OF INVENTION

In view of the foregoing, the main object of this invention is to provide a magnetic card filing assembly in which cards stacked in a card holder are retained therein by magnetic attraction, so that the file cards can be slid within the holder, angled therein to permit their inspection, or removed from the holder and replaced with another card without, in doing so, in any way mutilating the cards.

More particularly, an object of the invention is to provide an assembly of the above type in which each card has attached to its lower edge a steel or other ferromagnetic band which cooperates with permanent magnet rails included in the card holder.

A significant advantage of a file card in accordance with the invention is that the metal band at the bottom edge of the cards acts not only to strengthen and stiffen the cards but also functions to afford a slight separation therebetween to facilitate angling of the cards for inspection or removal of the cards from the holder.

Also an object of the invention is to provide an assembly of the above type in a format in which the holder includes a rotatable cylinder and the stack of cards retained magnetically on the cylinder are in a circular array thereabout.

Still another object of the invention is to provide a magnetic card filing assembly which may be mass produced at low cost and which functions in a reliable and efficient manner.

Briefly stated, these objects are attained in a card filing assembly in which file cards are accommodated in a tray or other holder dimensioned to store a stack of cards, each of which at its lower edge has a stripe or band of ferromagnetic material attached thereto. The file card holder is provided with opposing side walls to confine the stack of cards to the holder and a pair of parallel rails each defined by a transversely-polarized permanent magnet strip running the length of the holder and sandwiched between opposing pole pieces. The cards stored in the holder bridge the rails, with their lower edges resting on the pole pieces, whereby the cards are held to the rails by magnetic attraction, yet the cards so held may be angled to facilitate their inspection or slid along the rails, or removed from the rails without, in doing so, in any way mutilating the cards.

BRIEF DESCRIPTION OF DRAWINGS

For a better understanding of the invention as well as other objects and further features thereof, reference is made to the following detailed description to be read on conjunction with the accompanying drawings, wherein.

DESCRIPTION OF INVENTION

Cards

Figure 1:
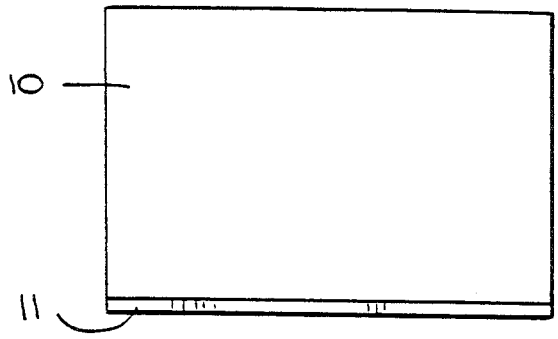
FIG. 1 is a side view of a preferred embodiment of a file card to be included in a magnetic filing card assembly in accordance with the invention.
Figure 2:
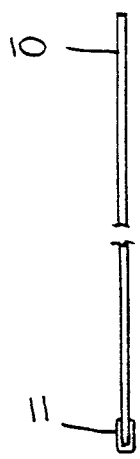
FIG. 2 is an end view of this card.

Referring now to FIGS. 1 and 2, there is shown in these figures a preferred embodiment of a file card 10 to be included in a magnetic card filing assembly in accordance with the invention. Card 10 is formed of paperboard or other suitable stock on which data to be filed may be written, typed or printed. Attached to the lower edge of card 10 along is full length is a metal band 11.

Band 11 is formed of a thin, flat strip of bendable ferromagnetic material such as steel, the strip being folded lengthwise in half to create two leaves s that the lower edge of the card can be inserted between the two leaves which ar then clinched to the card. Band 11 acts not only to render the card magnetically attractable, but it also serves to stiffen and strengthen the card lower edge so that the card can survive handling over a long period in a filing system.

Figure 3:
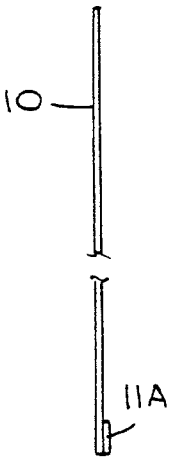
FIG. 3 is an end view of a modified card.
Figure 4:
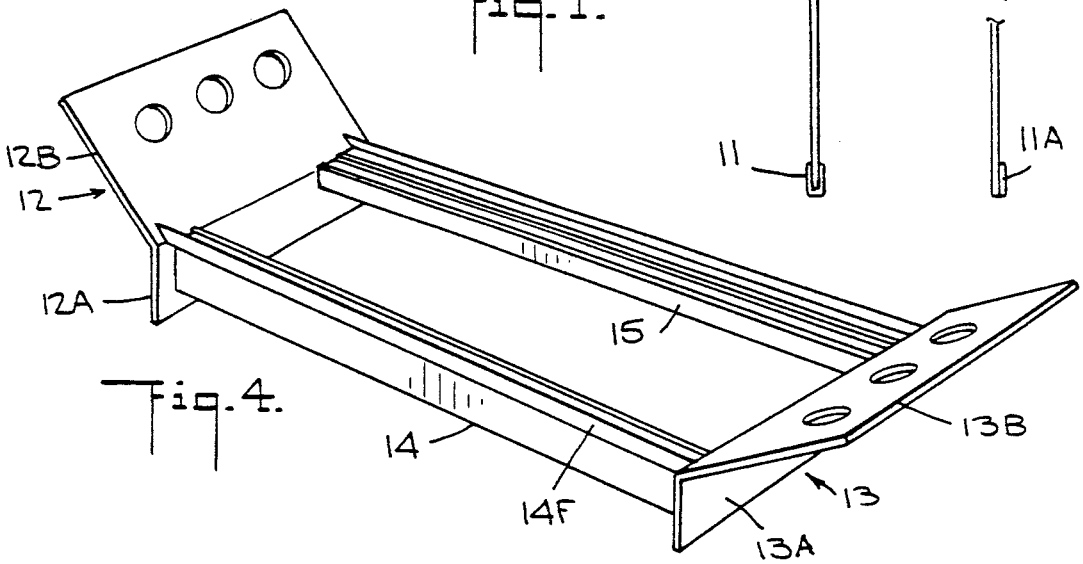
FIG. 4 is a perspective view of a preferred embodiment of the holder included in the assembly.

Alternatively, as shown in FIG. 3, card 10 may be provided at its lower edge with a straight band 11A of thin steel adhered to one side of the edge by a suitable bonding agent. Or a pressure-sensitive adhesive tape may be used to hold the ferromagnetic band to one side of the card.

Instead of attaching a ferromagnetic band to the lower edge of the card, a steel wire having a square or circular cross section may be used for the same purpose. And instead of a metal band or wire, the lower edge of the card may have coated therein a stripe constituted by steel or ferrite powders dispersed in a resinous binder.

But regardless of whether the ferromagnetic element of high permeability takes the form of a band, a wire or a stripe, its function is to cause the lower edge of the card to which the element is attached to be attracted magnetically to a permanent magnet rail included in a tray, cabinet or other form of holder for storing file cards.

The file card need not be in the form of a single sheet, but it may be constituted by a folder to hold paper documents, in which case the ferromagnetic element would be attached at the fold line. Or the file card could take the form of a multi-channel microfiche jacket loaded with microfilm strips, in which case the ferromagnetic element would be attached to the lower edge of this jacket. Or the card may have folded thereover a clear filing pocket, the card and pocket being clinched together.

The Holder

As shown in FIGS. 4 to 9, a preferred form of holder for a stack of file cards whose lower edges each have a ferromagnetic element attached thereto includes non-magnetic end plates 12 and 13, each having a vertical lower section 12A–13A, and an outwardly inclined upper section 12B–13B whose purpose is to permit the cards stored in the holder to lean in either direction.

Extending between the lower section of end plates 12 and 13 and attached thereto by bolts or other means is a pair of parallel structural beams 14 and 15 having a channel formation, the beam being formed of aluminum or other non-magnetic material. In practice, the end plates and the structural beams may be molded of synthetic plastic to form a unitary holder.

Figure 7:
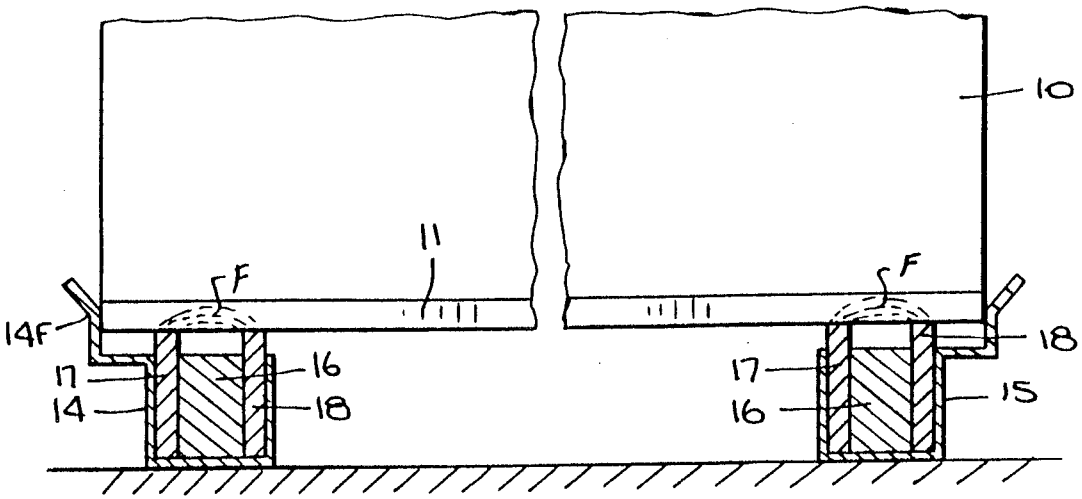
FIG. 7 is a transverse section taken through the beams of the holder and the rails nested therein, a file card resting on these rails.
Figure 6:
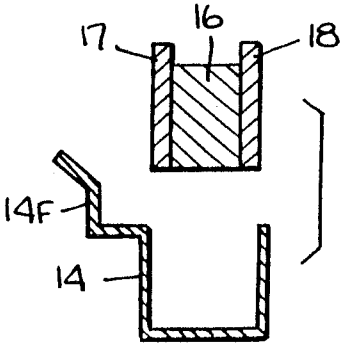
FIG. 6 is a transverse section taken through one of the structural beams included in the holder.

As shown by the cross section of beam 14 in FIG. 6, the outer wall of the channel-shaped beam is provided with a flange 14F having a horizontal lower section extending at right angles from the upper edge of the outer wall, a vertical intermediate section which serves as a side wall to confine the cards stored in the holder, and an outwardly inclined upper section which functions to guide an inserted card into the holder, as shown in FIG. 7.

Nested within the channel of each beam is a rail formed by a permanent magnet strip 16 that runs the full length of the beam, the strip being sandwiched between opposing pole pieces 17 and 18 whose height is somewhat greater than that of the strip. Hence, as shown in FIG. 7, the lower edge of each file card 10 stored in the holder rests on pole pieces 17 and 18 of the parallel rails, the cards bridging these permanent magnet rails.

Permanent magnet strips 16 are preferably of the flexible type manufactured and sold by Polymag, Inc., of Yaphank, N.Y., producers of polymer magnets. These flexible permanent magnets which can be fabricated in any desired configuration are composed of ferrite particles dispersed in an extruded matrix of plastic resin. They will not chip, break of crack, and are not affected by vibration or shock that could shatter a ceramic type magnet.

Permanent magnet flexible strips are also available from Permag, a subsidiary of The Dexter Corporation, as well as from the Magnetic Products division of B. F. Goodrich.

Figure 9:
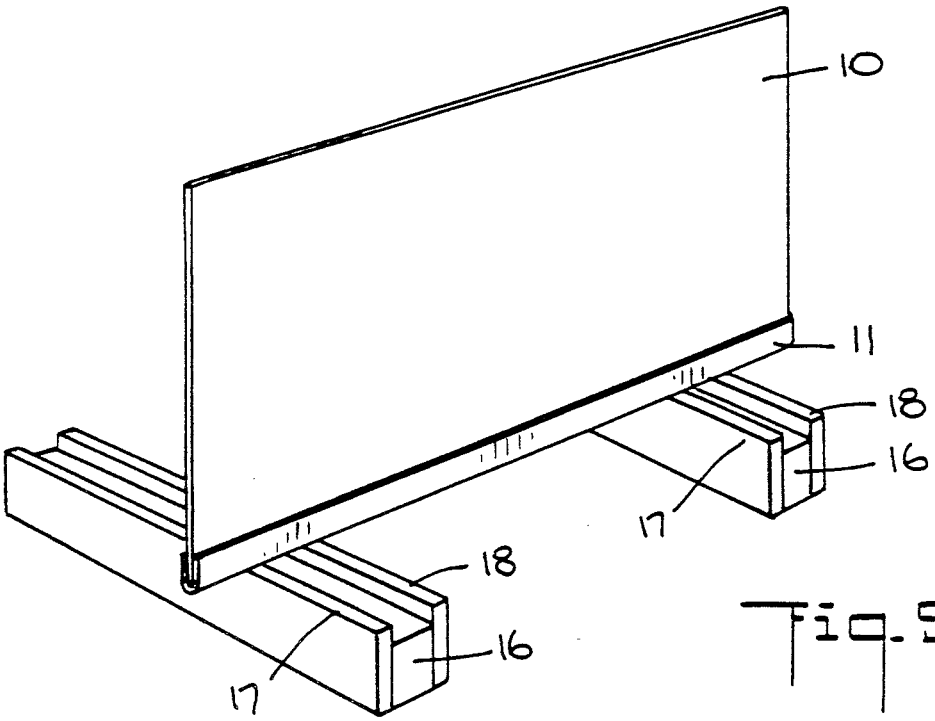
FIG. 9 schematically shows the relationship between a file card and the pair of parallel rails.

The permanent magnet strips are transversely polarized; hence the pole piece engaging one long side of the strip is North along its full length and the pole piece engaging the opposing long side is South. When, as shown in FIGS. 7 and 9, the ferromagnetic band 11 on the lower edge of a file card 10 rests on the pole pieces 17 and 18 of a magnetic rail, a magnetic circuit is created when lines of flux F extend through the ferromagnetic band from the North pole piece to the South pole piece. As a consequence, the magnetic holding power of the rails is strong and acts to firmly hold the cards to the rails.

Figure 5:
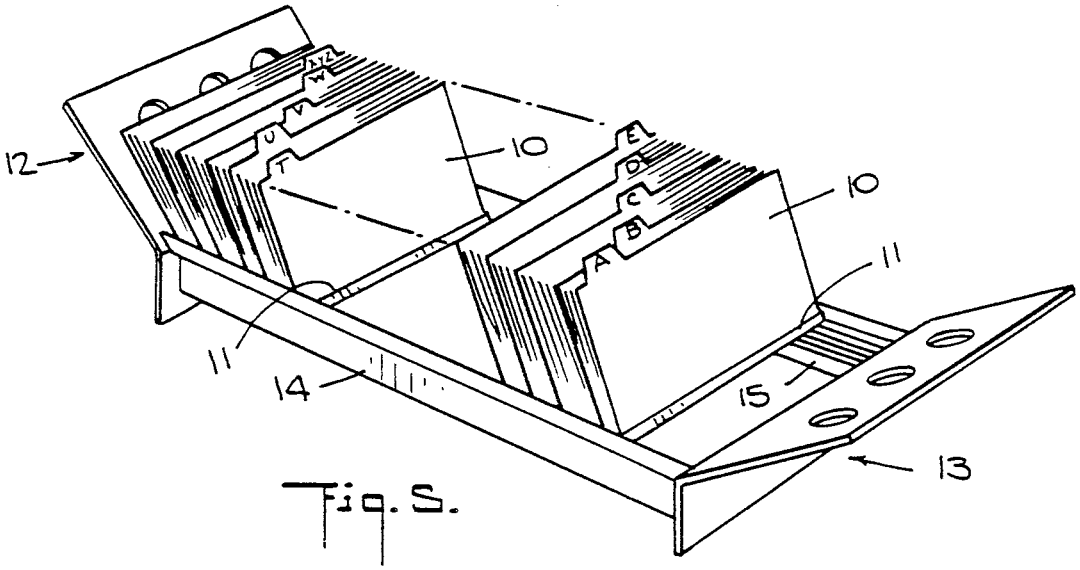
FIG. 5 shows the holder loaded with a stack of file cards.
Figure 8:
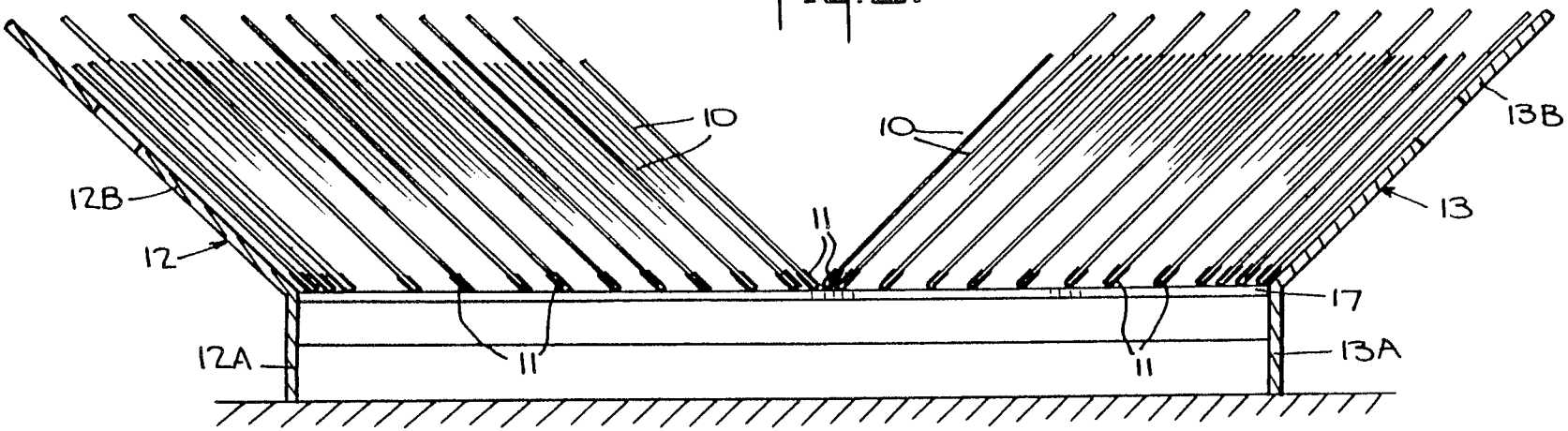
FIG. 8 schematically shows a stack of file cards separated into inclined sections to permit inspection.

When the holder is loaded with a stack of cards, a shown in FIGS. 5 and 8, while each card 10 is magnetically held by the rails of the holder, it is possible to angle the cards so as to inspect any card of interest without removing it from the file, or one may slide the cards along the rails to make room for additional cards; for while the magnetic circuit resists movement of the cards, it does not prevent such movement. Or one may remove any card from the holder by applying a sufficient pulling force to overcome the magnetic attraction holding the card onto the rails. None of these actions in any way mutilate the cards.

Roll-Type Holder

Figure 10:
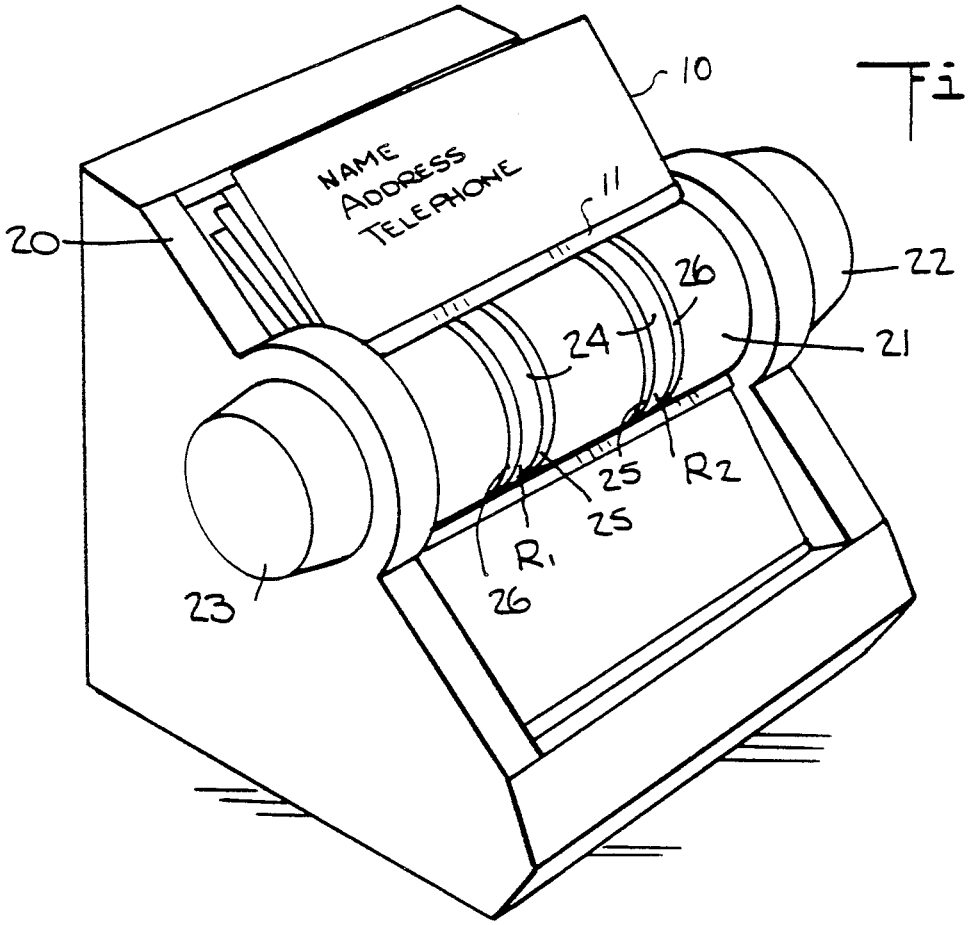
FIG. 10 is a roll-type assembly in accordance with the invention.

In the roll type file card holder shown in FIG. 10, mounted for rotation within a case 20 is a cylinder 21 having knobs 22 and 23 at either end so that an operator can turn the cylinder to find a desired card.

Embedded in the cylinder are a pair of spaced annular magnetic rails $R_1$ and $R_2$, each constituted by a permanent magnet ring 24 having a rectangular cross section sandwiched between a pair of annular pole pieces 25 and 26. The ring is transversely polarized so that one pole piece is North and the other, South.

Each file card 10 has at its lower edge a ferromagnetic band 11 which rests on the pole pieces of the rails, thereby holding the cards on the rails by magnetic attraction. The cards surround the cylinder in a circular array, and as with a conventional ROLADEX file, the cards fan out in that the outer circumference of the array is greater than its inner circumference. To obtain access to a particular file card, one simply rotates cylinder 21 until the card comes into view.

While there have been shown and described preferred embodiments of a magnetic card filing assembly in accordance with the invention, it will be appreciated that many changes and modifications may be made therein without, however, departing from the essential spirit thereof.

I claim:

1. A card filing assembly comprising:

(a) a stack of file cards each having a ferromagnetic element attached to and extending along the lower edge of the card; and (b) a holder for the stack of cards, said holder having side walls to confine the cards to the holder and a pair of permanent magnet parallel rails on which the lower edges of the cards rests and are magnetically attracted thereto, whereby the cards in the holder which are held by magnetic attraction to the rails can be angled to facilitate their inspection, or slid along the rails or removed therefrom.

2. An assembly as set forth in claim 1, wherein each rail is formed by a permanent magnet strip that is transversely polarized and sandwiched between opposing pole pieces on which the lower edge of each card rests.

3. An assembly as set forth in claim 1, wherein said ferromagnetic element is formed by a metal band attached to said lower edge.

4. An assembly as set forth in claim 3, wherein said band is formed by a thin strip of steel that is folded lengthwise in half to produce a pair of leaves between which the lower edge is inserted, the leaves being clinched thereto.

5. An assembly as set forth in claim 1, wherein said ferromagnetic element is a wire attached to said lower edge.

6. An assembly as set forth in claim 1, wherein said holder includes end plates and a pair of parallel beams whose ends are joined to said end plates, each beam being in a channel formation, said rails being nested in said beams.

7. An assembly as set forth in claim 6, wherein each beam channel has an outer wall provided with an upwardly extending flange, the flanges of the beams being shaped to define said side walls.

8. An assembly as set forth in claim 2, wherein said strip is formed by ferrite powders dispersed in a resinous binder.

9. An assembly as set forth in claim 1, in which said holder includes a rotatable cylinder on which is supported a circular array of said file cards, said cylinder being provided with a pair of annular permanent magnet rails.

* * * * *